US009789588B2

(12) United States Patent
Kawakami

(10) Patent No.: US 9,789,588 B2
(45) Date of Patent: Oct. 17, 2017

(54) FLUID PRESSURE CYLINDER

(71) Applicant: PASCAL ENGINEERING CORPORATION, Hyogo (JP)

(72) Inventor: Takayuki Kawakami, Hyogo (JP)

(73) Assignee: Pascal Engineering Corporation, Hyogo (JP)

( * ) Notice: Subject to any disclaimer, the term of this patent is extended or adjusted under 35 U.S.C. 154(b) by 338 days.

(21) Appl. No.: 14/442,264

(22) PCT Filed: Oct. 24, 2013

(86) PCT No.: PCT/JP2013/078846
§ 371 (c)(1),
(2) Date: May 12, 2015

(87) PCT Pub. No.: WO2014/087756
PCT Pub. Date: Jun. 12, 2014

(65) Prior Publication Data

US 2016/0271758 A1 Sep. 22, 2016

(30) Foreign Application Priority Data

Dec. 3, 2012 (JP) ..... 2012-264198

(51) Int. Cl.
*F15B 15/20* (2006.01)
*B25B 5/06* (2006.01)
(Continued)

(52) U.S. Cl.
CPC ..... *B25B 5/062* (2013.01); *B25B 5/061* (2013.01); *F15B 15/063* (2013.01);
(Continued)

(58) Field of Classification Search
CPC .. F15B 15/063; F15B 15/068; F15B 15/1466; F15B 15/149; F15B 15/2807; B25B 5/062
See application file for complete search history.

(56) References Cited

U.S. PATENT DOCUMENTS 7,111,834 B2 * 9/2006 Steele ..... F15B 15/063 92/31
9,511,466 B2 * 12/2016 Kawakami ..... F15B 15/2807
2015/0285280 A1 * 10/2015 Kawakami ..... B25B 5/062 91/418

FOREIGN PATENT DOCUMENTS

EP 2177309 A1 * 4/2010 ..... B23Q 1/0072
JP 60-129410 7/1985
(Continued)

*Primary Examiner* — Michael Leslie
(74) *Attorney, Agent, or Firm* — Norris McLaughlin & Marcus, P.A.

(57) ABSTRACT

A fluid pressure cylinder comprises a rod insertion hole formed in a piston member, an auxiliary rod provided to a head side wall member so as to be inserted into the rod insertion hole, an open/shut valve mechanism for detection, and a fluid passage that is opened and shut by the open/shut valve mechanism. The open/shut valve mechanism includes a valve body reception hole formed in the auxiliary rod, a valve body that is movably held in the valve body reception hole and that has a recessed engagement portion on its external peripheral portion, and a spherical body mounted on the auxiliary rod so as to engage with the recessed engagement portion; when the piston member has reached a set shifting position, the valve body is changed over to the closed position or to the opened position due to cooperation between the spherical body, the recessed engagement portion, and the inner peripheral wall portion of the rod insertion hole.

7 Claims, 13 Drawing Sheets

(51) Int. Cl.
*F15B 15/06* (2006.01)
*F15B 15/28* (2006.01)
*F15B 15/14* (2006.01)

(52) U.S. Cl.
CPC ..... *F15B 15/149* (2013.01); *F15B 15/1466* (2013.01); *F15B 15/2807* (2013.01)

(56) References Cited

FOREIGN PATENT DOCUMENTS

| | | |
|---|---|---|
| JP | 11-30201 | 2/1999 |
| JP | 2001-087991 | 4/2001 |
| JP | 2003-305626 | 10/2003 |
| JP | 2009-125821 | 6/2009 |
| JP | 2012-166275 | 9/2012 |
| JP | 2012-166276 | 9/2012 |

* cited by examiner

FLUID PRESSURE CYLINDER

TECHNICAL FIELD

The present invention relates to a fluid pressure cylinder that, when in particular a piston member has reached a predetermined shifting position that is set in advance, is able to detect the position of the piston member via air pressure that is changed over by a valve mechanism that opens or closes the state of communication of an air passage within a clamp main body, and that operates together with the operation of the piston member.

BACKGROUND OF THE INVENTION

Up to now, a fluid pressure cylinder employed in a clamp device or the like that clamps an object to be clamped, such as a workpiece etc. that is to be subjected to machining, has a main cylinder body, a piston member that is provided so as to move forwards and backwards freely within the main cylinder body, a fluid pressure operation chamber for driving the piston member toward at least one of the advance side and the retraction side.

Now, various types of rod position detection technique have been implemented in practice for detecting the forward limiting position, the rearward limiting position, an intermediate position of the piston member of the fluid pressure cylinder.

For example, the clamp device of Patent Document #1 detects the position of a piston rod with a pressure sensor that detects a fluid pressure supplied to a fluid pressure cylinder, and two position sensors that, detect a raised position and a lowered position of a detected element on the lower end portion of an actuation rod that is projected downward from a piston member of the fluid pressure cylinder to the exterior.

And, in the clamp device of Patent Document #2, a mechanism that operates together with the raising and lowering operation of an output rod of a fluid pressure cylinder to open and close an air passage is provided at the exterior of one end of the main cylinder body, and thereby this structure is capable of detecting the raised position and the lowered position of the output rod.

Moreover, with the clamp device of Patent Document #3, a workpiece holding stand that supports and holds the object to be clamped is provided independently. The workpiece holding stand includes a pad member in which an air ejection outlet is formed and an external barrel member that supports the pad member while elastically biasing it toward the object to be clamped. When the pad member is in its projected position, pressurized air is ejected from the air ejection outlet, and when the clamp device is driven for clamping and the pad member is pressed and retracted by the object to be clamped, the air ejection outlet is blocked by the outer barrel member, so that the pressure of the pressurized air rises and the fact that the clamp device has gone into its clamped state can be detected.

Patent Document #1: JP Laid Open Patent Publication 2001-87991.

Patent Document #2: JP Laid Open Patent Publication 2003-305626.

Patent Document #3: JP Laid Open Patent Publication 2009-125821.

SUMMARY OF THE INVENTION

With the clamp device of Patent Document #1 since the actuation rod is projected from the piston member of the fluid pressure cylinder to the exterior, and the raised position and the lowered position of the detected element provided, at the lower end portion of this actuation rod are detected with the two position sensor, accordingly it is necessary to provide a space for detection at the lower side of the fluid pressure cylinder in order for the detected element to be able to shift and for installation of the position sensor, and therefore the problem arises that the clamp device (in other words, the fluid pressure cylinder) is increased in size.

With the clamp device of Patent Document #2, the mechanism that detects the raised position and the lowered position of the output rod is provided externally to the clamp main body. Due to this, in a similar manner to the case with the clamp device of Patent. Document #1, it is necessary to provide a space for detection externally to the main body of the clamp, so that it is not possible to make the clamp device compact.

And since, when the clamp device is in its unclamped state, the air ejection outlet of the workpiece holding stand of the clamp device of Patent Document #3 opens at a portion in the neighborhood of the clamp device and of the object that is to be clamped, accordingly there is a fear that swarf due to mechanical processing or coolant (i.e. cutting fluid) may undesirably get into the air ejection outlet and block it.

The object of the present invention is to provide a fluid pressure cylinder that, with a simple structure, can open or close an open/shut valve mechanism for detection in coordination with the operation of a piston member, and that is thus capable of detecting via a fluid pressure and with excellent operational reliability, the fact that the piston member has shifted to a set shifting position.

The present invention presents a fluid pressure cylinder comprising a main cylinder body having a cylinder bore is formed, a piston member having a piston portion that is movably received in the cylinder bore and an output rod extending from the piston portion to an exterior of the main cylinder body, and a fluid pressure operation chamber that is defined in the cylinder bore, and characterized by comprising: a rod insertion hole that is formed at a central portion of a base end portion of the piston member and that opens to the base end, and into which a fluid pressure in the fluid pressure operation chamber is introduced; an auxiliary rod that is provided on a head side end wall member of the main cylinder body so as to project within the cylinder bore, and that can be inserted into the rod insertion hole; an open/shut valve mechanism for detection that is installed to the auxiliary rod; and a fluid passage that is formed in the main cylinder body and the auxiliary rod, and that is opened and shut by the open/shut valve mechanism; wherein the open/shut valve mechanism comprises: a valve body reception hole that is formed in an top end side portion of the auxiliary rod to be parallel to an axis of the cylinder bore, and that; communicates with the rod insertion hole; a valve body that is movably received in the valve body reception hole and that has a recessed engagement portion on an external peripheral portion; and a spherical body that is movably fitted to the auxiliary rod so as to engage with the recessed engagement portion; and, when the piston member reaches a set shifting position that is set in advance, the valve body is changed over to a shut position or to an open position due to cooperation between the spherical body, the recessed engagement portion, and a rod insertion hole inner circumferential wall portion.

The present invention may have the following configurations.

As 1st example, preferably, an engagement portion for retraction is formed on an inner circumferential wall portion of the rod insertion hole and, when the piston member is in the set shifting position, puts the valve body into the shut position by permitting the spherical body to retract in a direction to recede away from the axis.

As 2nd example, preferably, when the piston member is shifted from the set shifting position, the valve body is changed over to the open position due to cooperation between the spherical body, the recessed engagement portion, and the rod insertion hole inner circumferential wall portion.

As 3rd example, preferably, an engagement portion for pressing is formed on an inner circumferential wall portion of the rod insertion hole, and, when the piston member is in the set shifting position, puts the valve body into the open position by causing the spherical body to shift in a direction to approach toward the axis.

As 4th example, preferably, the valve body is biased toward the shut position by fluid pressure in the rod insertion hole which is communicated with the fluid pressure operation chamber.

As 5th example, preferably, a compression spring is provided that elastically biases the valve body toward the head side end wall member.

As 6th example, preferably, a shut state of the open/shut valve mechanism can be detected via a fluid pressure that is supplied to the fluid passage.

According to the present invention, the fluid pressure cylinder comprises the rod insertion hole, the auxiliary rod, the open/shut valve mechanism for detection, and the fluid passage that is opened and closed by the open/shut valve mechanism; the open/shut valve mechanism comprises the valve body reception hole that is formed in an end side portion of the auxiliary rod; the valve body that is movably received in the valve body reception hole and that has a recessed engagement portion in an external peripheral portion; and the spherical body that is movably installed to the auxiliary rod and that can engage with the recessed engagement portion; and, when the piston member reaches the set; shifting position that is set in advance, it is arranged for the valve body to be changed over to the shut position or to the opened position due to cooperation between the spherical body, the recessed engagement portion, and the rod insertion hole inner circumferential wall portion.

Accordingly it is possible to detect the fact that the piston member has shifted to its set shifting position via the fluid pressure supplied to the fluid passage and to the open/shut valve mechanism, since, when the piston member has shifted to its set shifting position, the open/shut valve mechanism changes over to its shut position or to its opened position and intercepts, or cancels interception of, the fluid passage.

Since the open/shut valve mechanism is provided to the auxiliary rod that is installed to the head side end wall member so as to project into the cylinder bore, accordingly the open/shut valve mechanism is disposed internally to the main cylinder body, so that it is possible to make the fluid pressure cylinder more compact. And since, when the piston member reaches its set shifting position, it is arranged for the open/shut valve mechanism to change over the valve body to the shut position or to the opened position due to cooperation between the spherical body, the recessed engagement portion, and the rod insertion hole inner circumferential wall portion, accordingly it is possible to change over the open/shut valve mechanism together with the movement of the piston member with a simple structure.

According to theist example, it is possible to put the valve body into the shut position with a simple structure, since the valve body is into the shut position by the spherical body being permitted to retract in the direction to recede away from the axis by the engagement portion for retraction which is formed on the inner circumferential wall portion of the rod insertion hole.

According to the 2nd example, it is possible to detect the fact that the piston member has shifted from its limit shifting position reliably and in a simple manner, since, when the piston member is shifted from the set shifting position, the valve body is changed over to the opened position due to cooperation between the spherical body, the recessed engagement portion, and the rod insertion hole inner circumferential wall portion.

According to the 3rd example, it is possible to make the open/shut valve mechanism go to the opened state when the piston member has reached its set shifting position, since the engagement portion for pressing and shifting is formed on the inner circumferential wall portion of the rod insertion hole, and, when the piston member is in its limit shifting position, puts the valve body into the opened position by causing the spherical body to shift in the direction to approach toward the axis.

According to the 4th example, it is possible to enhance the valve closing performance and to maintain the closed state in a stable manner, since it is arranged for the valve body to be biased toward the closed position by fluid pressure in the rod insertion hole which is communicated with the fluid pressure operation chamber.

According to the 5th example, it is possible to enhance the valve closing performance and to maintain the closed state in a stable manner, since the compression spring is provided that biases the valve body toward the head side end wall member.

According to the 6th example, it is possible to detect the closed state with a simple structure, since the closed state of the open/shut valve mechanism is detected via a fluid pressure that is supplied to the fluid passage.

DETAILED DESCRIPTION OF THE PREFERRED EMBODIMENTS

Figure 1:
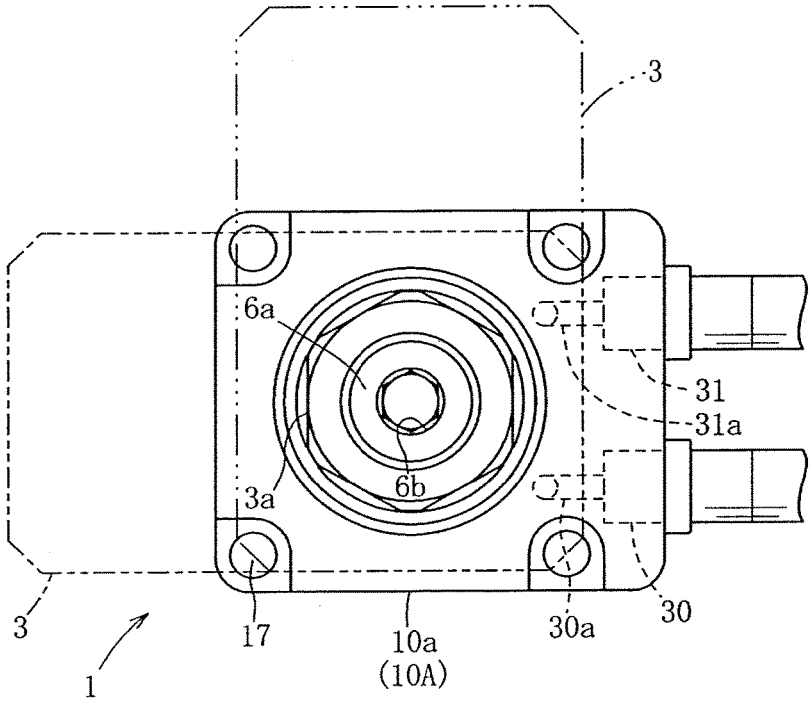
FIG. 1 is a plan view of a twist-type clamp device according to a first embodiment of the present invention.

In the following, best mode for implementation of the present invention will be explained on the basis of embodiments thereof.

In the following embodiments, "hydraulic pressure" means compressed oil.

Embodiment 1

The twist-type clamp device 1 of this embodiment will now be explained on the basis of FIGS. 1 through 6.

This twist-type clamp device 1 comprises a hydraulic pressure cylinder 2 (fluid pressure cylinder), a clamp arm 3 that is fixed to the upper end portion of an output rod 6 of the hydraulic pressure cylinder 2, and a twisting mechanism 8 that causes the output rod 6 to twist through a set angle around its axis (for example, 90°). The base end portion of the clamp arm 3 is fitted over a tapered axis portion 6*a* of the output rod 6, and is fixed there by a nut 3*a* that is screwingly engaged to the upper end portion of the output rod 6.

In the state in which the output rod 6 is retracted to its lower limit position or to a position in the neighborhood thereof, this twist-type clamp device 1 goes into its clamped state in which the object to be clamped is pulled downward by the clamp arm 3; and, when the output rod 6 is extruded from the clamped state, the clamp device 1 goes into its unclamped state. When the device 1 transitions from its unclamped state shown in FIG. 2 to its clamped state shown in FIG. 5, the output rod 6 twists, for example, around its axis by 90° in the anticlockwise rotational direction as seen in plan view. And, conversely to the above, when the device 1 transitions from its clamped state to its unclamped state, the output rod 6 twists by 90° in the clockwise rotational direction.

First, the hydraulic pressure cylinder 2 will be explained.

Figure 2:
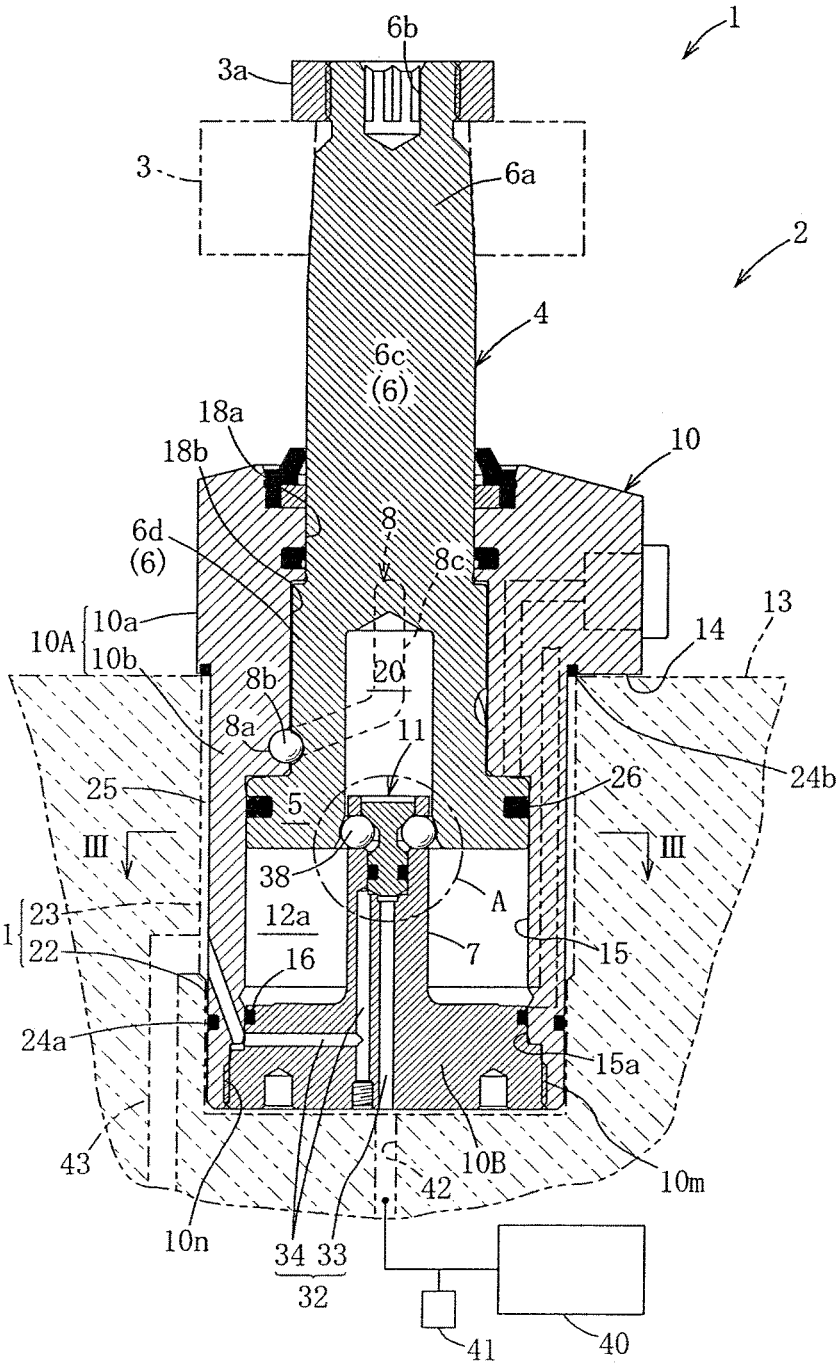
FIG. 2 is a vertical sectional view of the clamp device of FIG. 1 (unclamped state)
Figure 3:
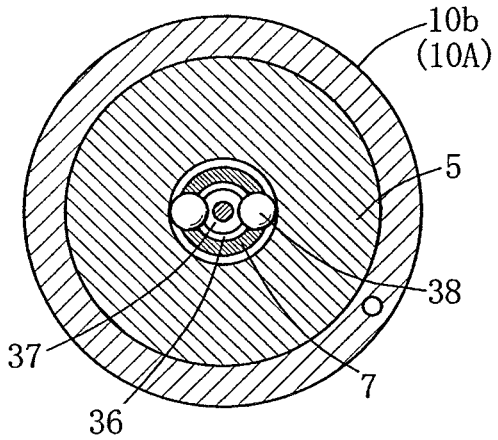
FIG. 3 is a sectional view taken along lines III-III of FIG. 2.
Figure 5:
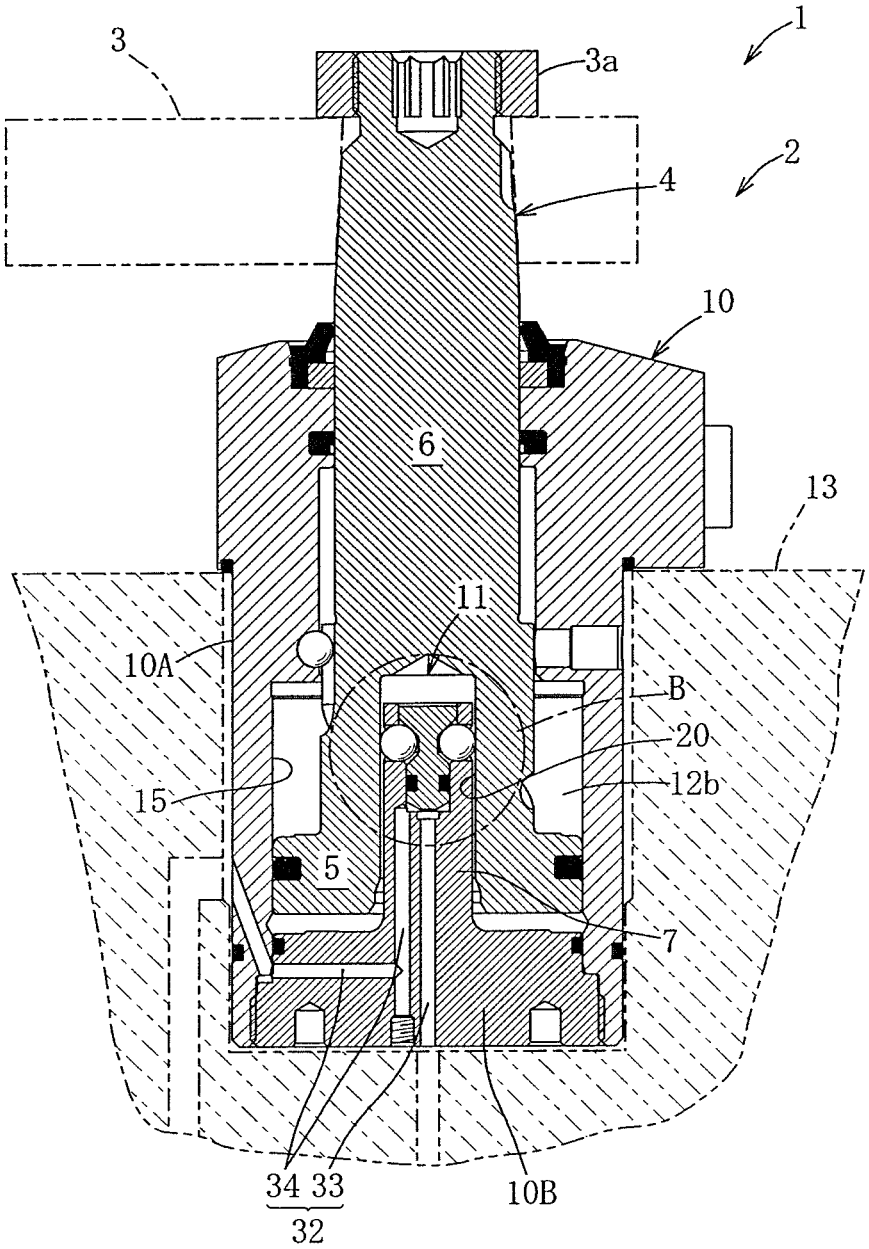
FIG. 5 is a vertical sectional view of the clamp device (clamped state) of FIG. 1.

As shown in FIGS. 1, 2, and 5, the hydraulic pressure cylinder comprises a main cylinder body 10, a piston member 4, a hydraulic pressure operation chamber for unclamping 12*a*, a hydraulic pressure operation chamber for clamping 12*b*, an auxiliary rod 7, an open/shut valve mechanism 11, an air passage 32, and so on. The main cylinder body 10 comprises an upper main cylinder body portion 10A and a head side end wall member 10B.

The upper main cylinder body portion 10A comprises a rectangular main cylinder body portion 10*a* that is rectangular in plan view, and a main cylinder body portion 10*b* that extends downward from the lower end of the rectangular main cylinder body portion 10*a* and is shaped like a barrel. An installation surface 14 is formed at the lower end of the rectangular main cylinder body portion 10*a* for installation on the upper surface of a base member 13. The upper main cylinder body portion 10A is fixed to the base member 13 by four bolts that are inserted in four bolt holes 17.

A rod hole 18*a* through which the output rod 6 passes is formed in the rectangular main cylinder body portion 10*a*, and a large diameter rod hole 18*b*, concentric with and of larger diameter than the rod hole 18*a*, is formed in the rectangular main cylinder body portion and the barrel shaped main cylinder body portion 101), and a cylinder bore 15 is formed in the interior of the barrel shaped main cylinder body portion 10*b* so as to communicate with the lower end of the large diameter rod hole 18*b*, and with the lower end side of the cylinder bore 15 being blocked by the head side end wall member 10B.

The upper end portion of the head side end W member 10B is fitted into a fitting hole 15*a* that connects to the cylinder bore 15 and is sealed by a seal member 16. A male screw portion 10*m* that is formed on the lower end portion of the head side end wall member 10B is screwingly engaged into a screw hole 10*n* in the barrel shaped main cylinder body portion 10*b*, and thereby that the head side end wall member 10B is fixed to the barrel shaped main cylinder body portion 10*b*. An auxiliary rod 7 is formed integrally with the center portion of the head side wall number 10B so as to project into the cylinder bore 15, and has a diameter of around ¼ to ⅓ of the diameter of the cylinder bore 15. It would also be acceptable for the auxiliary rod 7 to be formed as a separate member from the head side end wall member 10B, and to be fixedly attached thereto.

An installation hole 21 into which the barrel shaped main cylinder body portion 10*b* and the head side end wall member 10B are inserted from above and installed is formed in the base member 13 to which the twist-type clamp device 1 is attached, and the installation hole 21 is made as a lower installation hole portion 22 and an upper installation hole portion 23 that is slightly larger in diameter than the lower installation hole portion 22, and the lower end side portion of the barrel shaped main cylinder body portion 10*b* and a seal member 24*a* fitted on its external periphery is installed in the lower installation hole portion 22. An annular cylindrical gap 25 is defined in the upper installation hole portion 23 around the external circumference of the barrel shaped main cylinder body portion 10*b*. A seal member 24*b* is installed at the upper end portion of the barrel shaped main cylinder body portion 10*b*.

Next, the piston member 4 will be explained.

As shown in FIG. 2, 5, the piston member 4 comprises a piston portion 5 that is installed in the cylinder bore 15 so as to slide freely in the vertical direction, the output rod 6 extending from the piston portion 5 upwards to the exterior of the main cylinder body 10, and a rod insertion hole 20 that is formed in the center portion of the base end portion of the piston member 4 (i.e. lower end portion) so as to open to its base end lower end). A seal member 26 is fitted on the external circumference of the piston portion 5. And a hexagonal opening 6*b* for insertion of a wrench is formed at the upper end of the output rod 6. The output rod 6 comprises a small diameter rod portion 6*c* that passes through the rod hole 18*a* and extends upward horn the clamp main body 10, and a large diameter rod portion tad that extends integrally downward from the lower end of the small diameter rod portion 6*c* and is inserted into the large diameter rod hole 18*b*. The rod insertion hole 20 is a cylindrical aperture that has the same diameter over its entire length and is formed as a cylindrical hole having a slightly larger diameter (for example, 1 to 2 mm greater) than the external diameter of the auxiliary rod 7; and this rod insertion hole 20 is communicated with the hydraulic pressure operation chamber 12*a*, and is formed so that the auxiliary rod 7 can be inserted into the rod insertion hole 20.

Now an explanation will be given of the twisting mechanism 8, which causes the output rod 6 (i.e., the piston member 4) to twist by a set angle (for example, 90°) around its axis together with the forwards and backwards movement of the output rod 6, and which is installed to the large diameter rod 6*d* and the main cylinder body 10 of the hydraulic pressure cylinder 2. The twisting mechanism 8 has three reception apertures 8*a*, three steel balls 8*b* that are held in these reception apertures 8*a*, and three helical grooves 8*c*. The three reception apertures 8*a* are hemispherical, and are formed near the lower end of the circumferential wall portion of the large diameter rod hole 18*b* in three positions deriding equally the circumference, and the three helical grooves 8*c* are formed in the external circumferential wall portion of the large diameter rod portion 6*d*, and are engaged with the three steel balls 8*b* which are held in the three reception apertures 8*a*.

Due to this twisting mechanism 8, the piston member 4 twists by 90° in the anticlockwise rotational direction as seen in plan view when it is lowered from its unclamp position shown in FIG. 2 (i.e. its upper limit position) to an almost intermediate position that is in the middle between its upper limit position and its lower limit position, and thereafter is further lowered straightly downward to its clamp position (i.e. lower limit position; along approximately half its stroke (refer to FIG. 5).

Conversely to the above, when changing over from its clamp position to its unclamp position, the piston member 4 first rises straightly upward along approximately half its stroke, and then, when further rising from its almost intermediate position to its upper limit position shown in FIG. 2, it twists by 90° in the clockwise rotational direction as seen in plan view to reach its unclamp position.

The cylinder bore 15 is divided by the piston portion 5 into upper and lower volumes, and thereby the hydraulic pressure operation chamber for clamping 12*b* defined above the piston portion 5 and the hydraulic pressure operation chamber for unclamping 12*a* is defined below the piston portion 5. The hydraulic pressure operation chambers 12*a*, 12*b* correspond to the "fluid pressure operation chambers".

Hydraulic pressure ports 30, 31 are formed in the rectangular main cylinder body portion 10*a* of the upper main cylinder body portion 10A, with the hydraulic pressure port 30 being communicated with the hydraulic pressure operation chamber 12*a* by a hydraulic passage 30*a* formed in the main cylinder body 10 while the hydraulic pressure port 31 is communicated with the hydraulic pressure operation chamber 12*b* by a hydraulic passage 31*a* also formed in the main cylinder body 10, and with the hydraulic pressure ports 30, 31 being connected to a hydraulic pressure supply source (not shown in the figures) by hydraulic hoses or the like.

Next, the open/shut valve mechanism 11 and the air passage 32 (fluid passage) will be explained. This open/shut valve mechanism 11 is installed in the upper end portion of the auxiliary rod 7, and an intermediate portion of the an passage 32, which is formed in the main cylinder body 10 and the auxiliary rod 7, is opened and shut by the open/shut valve mechanism 11. The air passage 32 includes an upstream side air passage 33 and a downstream side air passage 34. The upper end of the upstream side air passage 33 is communicated with the central portion of the lower end of a valve body reception hole 35, and the upper end of the downstream side air passage 34 is communicated with an outer peripheral portion of the lower end of the valve body reception hole 35. Pressurized air is supplied from a pressurized air supply source 40 to the upstream side air passage 33 via an air passage 42 in the base member 13 and the lower to installation hole portion 22, and, when the open/shut valve mechanism 11 is in its open state, the pressurized air flows to the downstream side air passage 34, and passes out through the annular gap 25 and an air passage 43 in the base member 13 and is vented to the atmosphere.

As shown in FIGS. 2 and 5, the open/shut valve mechanism 11 comprises the valve body reception hole 35, a valve body 36 that is movably received in the valve body reception hole 35, an annular recessed engagement portion 37 that is formed on the external peripheral portion of the valve body 36, two spherical bodies 38 that consist of steel balls and that are capable of engaging with the recessed engagement portion 37, and an annular engagement portion 39 for retraction that is formed on the internal circumferential wall portion of the rod insertion hole 20 and that is capable of partial engagement with the spherical bodies 88.

The valve body reception hole 35 is formed in the end portion of the auxiliary rod 7 (i.e. upper end portion), approximately in the form of a cylinder that is concentric with the axis of the cylinder bore 15, and the valve body reception hole 35 is communicated with the hydraulic pressure operation chamber 12*a* via a minute annular gap between the auxiliary rod 7 and the rod insertion hole 20. The internal diameter of the approximately ¼ to ⅓ portion of the valve body reception hole 35 at its upper end is formed to be slightly larger than the internal diameter of the other portions thereof, and the internal diameter reduces smoothly from the large diameter portion.

Figure 4:
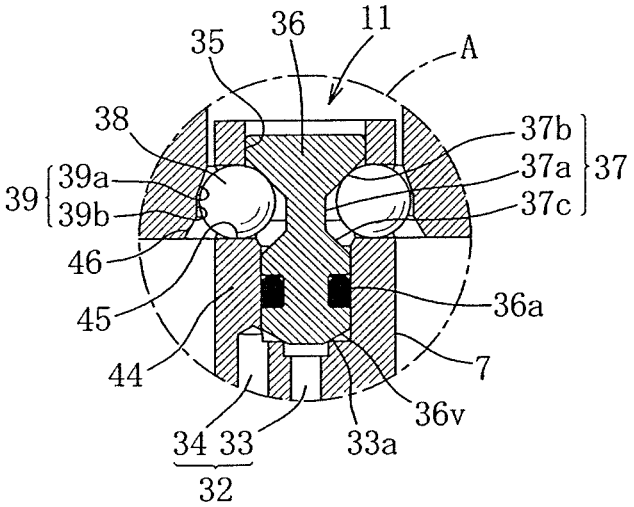
FIG. 4 is an enlarged view of a portion A of FIG. 2.

As shown in FIG. 2 and FIG. 4, the valve body 36 is received in the valve body reception hole 35 so as to be movable therein in the vertical direction, and is adapted to be capable of receiving the hydraulic pressure in the rod insertion hole 20, with the length of the valve body 36 in the vertical direction and the length of the valve body reception hole 35 in the vertical direction being almost equal. The annular recessed engagement portion 37 is formed around the external peripheral portion of an intermediate portion of the valve body 36. This recessed engagement portion 37 has a small diameter cylindrical surface 37*a* at this intermediate portion, an upper side conical surface portion 37*b* that continues upward from the upper end of this cylindrical surface 37*a* and increases in diameter upwards, and a lower side conical surface portion 37*c* that continues downward from the lower end of the cylindrical surface 37*a* and increases in diameter downwards. A flat surface is formed at the central portion of the lower end portion of the valve body 36, and, so as to continue to the external periphery of this flat surface, a valve surface 36*v* is formed consisting of a conical surface portion that increases in diameter upwards. A seal member 36*a* is installed on the external periphery of the lower portion of the valve body 36.

For example, two reception apertures 45 are formed in the wall portion 44 of the auxiliary rod 7, around the external circumference of its valve body reception hole 35. These reception apertures 45 are small diameter cylindrical apertures oriented in the horizontal direction. The spherical bodies 38 are installed in these reception apertures 45 so as to be movable in the horizontal direction, and are held so as to be capable of engagement with the recessed engagement portion 37. The diameter of the spherical bodies 38 is set to be greater than the thickness of the wall portion 44.

As shown in FIG. 4, a shallow annular groove shaped engagement portion for retraction 39 to which the spherical bodies 38 engage when the piston member 4 is in its unclamp position (i.e. upper limit position) is formed around the inner circumferential wall portion of the rod insertion hole 20 in the neighborhood of its lower end portion. The upper half portion to of the engagement portion for retraction 39 is formed as a tapered hole 39*a* that increases in diameter downward, and the lower half portion of the engagement portion for retraction 39 is formed as a cylindrical hole 39*b* that connects to the lower end of the tapered hole 39*a*. The maximum internal diameter of the engagement portion for retraction 39 is slightly larger (for example, 3 to 4 mm larger) than the external diameter of the auxiliary rod 7. And a conical surface portion 46 that increases in diameter downward is formed at the lower end portion of the internal circumferential wall portion, so as to connect to the lower end of the engagement portion for retraction 39.

As shown in FIGS. 2 and 4, in the unclamped state, since hydraulic pressure in the rod insertion hole 20 acts on the upper end of the valve body 36 and the spherical bodies 33 engage into the engagement portion for retraction 39 and the spherical bodies 38 shift slightly outward, accordingly shifting downward of the upper side conical surface portion 37*b* of the recessed engagement portion 37 is permitted and the valve body 36 lowers, so that the valve surface 36*v* on the lower end of the valve body 36 contacts against a valve seat 33*a* on the upper end of the upstream side air passage 33, and the open/shut valve mechanism 11 goes into its shut state. This shut state is detected by using the detection signal from a pressure switch 41 or a pressure sensor that is connected in the pressurized air supply system.

Figure 6:
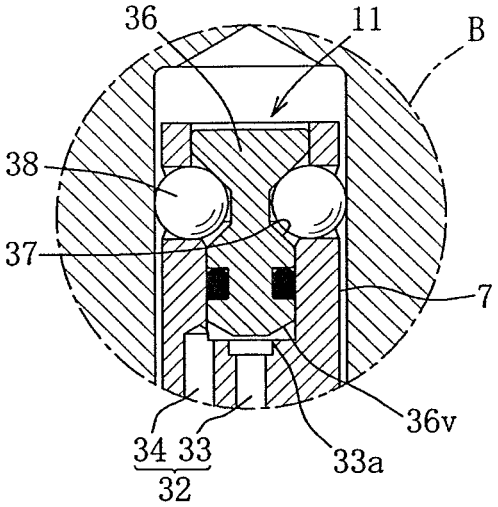
FIG. 6 is an enlarged view of a portion B of FIG. 5.

And since, as shown in FIGS. 5 and 6, when the piston member 4 shifts more downward than its unclamp position, the engagement portion for retraction 39 shifts further downward than the spherical bodies 38 and thereby the spherical bodies 38 are pushed toward the valve body 36 by the cylindrical inner circumferential wall surface of the rod insertion hole 20, accordingly the spherical bodies 38 press the upper side conical surface portion 37*b* of the recessed engagement portion 37 upward. Due to this, the valve body 36 shifts slightly upward, and a gap is formed between the valve surface 36*v* of the valve body 36 and the valve seat 33*a*, so that the open/shut valve mechanism 11 goes into its opened state.

Next, the operation and the advantageous effects of this twist-type clamp device 1 will be explained.

As shown in FIGS. 1 and 2, in the unclamped state, the piston member 4 is positioned at its upper limit position (which corresponds to the "set shifting position that is set in advance") and hydraulic pressure is charged into the hydraulic pressure operation chamber 12*a*, and since, at this time, in the open/shut valve mechanism 11, the hydraulic pressure in the hydraulic pressure operation chamber 12*a* and the same hydraulic pressure in the rod insertion hole 20 act on the upper end of the valve body 36, and moreover the spherical bodies 38 engage into the engagement portion for retraction 39 and the spherical bodies 33 do not press on the upper side conical surface portion 37*a* of the recessed engagement portion 37 of the valve body 36, accordingly, as shown in FIGS. 2 and 4, the valve body 36 is lowered to its lower limit position, and the valve goes into its closed state. Since, due to this, the air pressure in the air passage 42 rises and the pressure switch 41 goes ON, accordingly the fact that the twist-type clamp device 1 is in its unclamped state can be detected by a control unit that is connected to the pressure switch 41.

When, in order to clamp an object, to be clamped, the hydraulic pressure in the hydraulic pressure operation chamber 12*a* is changed over to drain pressure, and hydraulic pressure is supplied to the hydraulic pressure operation chamber for clamping 12*b*, then the piston member 4 lowers to its clamp position, and, as shown in FIG. 5, the object is clamped in the state in which the output rod 6 has been twisted by 90° in the anticlockwise direction.

And, in the state in which the piston member 4 has been lowered below its upper limit position (i.e. unclamp position), since the engagement portion for retraction 39 goes into the state of being lowered below the spherical bodies 38 and the spherical bodies 38 are pressed toward the valve body 36 by the inner circumferential wall surface of the rod insertion hole 20, so that these spherical bodies 38 press the upper side conical surface port ion 37*b* of the recessed engagement portion 37 of the valve body 36 upward, accordingly the valve body 36 shifts slightly upward, and the open/shut valve mechanism goes into its open state, as shown in FIGS. 5 and 6. Since, due to this, the pressure switch 41 returns to OFF, accordingly it is possible to detect the fact that the unclamped state has ceased.

Since, in this manner, when the piston member 4 has shifted to its unclamp position (its limit shifting position, in other words its set shifting position), the open/shut valve mechanism 11 changes over to its shut position and the air passage 32 is intercepted, accordingly it is possible to detect the fact that the piston member 4 is shifted to its unclamp position via the open/shut valve mechanism 11 and via the air pressure supplied to the air passage 32. And, since the valve body 36 is biased to the shut position by the hydraulic pressure in the hydraulic pressure operation chamber for unclamping 12*a*, accordingly the closing performance and the operational reliability of the open/shut valve mechanism 11 are excellent.

Since the open/shut valve mechanism 11 is installed in the auxiliary rod 7 that does not project to the exterior of the main cylinder body 10, and is thus installed in the interior of the main cylinder body 10, accordingly it is possible to anticipate that the hydraulic pressure cylinder 2 can be made more compact. And, since the valve body 36 of the open/shut valve mechanism 11 has the annular recessed engagement portion 37 on its external peripheral portion, and the spherical bodies 38 are capable of engaging into the recessed engagement portion 37, and since the open/shut valve mechanism 11 is built so as to be closed by the engagement portion for retraction 39 that is formed in the internal circumferential wall portion of the rod insertion hole 20 of the auxiliary rod 7 and the spherical bodies 38, accordingly it is possible to make the open/shut valve mechanism 11 open and close together with the movement of the piston member 4 with a simple structure.

While, in this embodiment, a structure is provided in which the engagement portion for retraction 39 is formed at a portion in the neighborhood of the lower end of the internal circumferential wall portion of the rod insertion hole 20, so as to detect the fact that the piston member 4 has reached the unclamp position, it would also be possible to provide a structure in which the engagement portion for retraction 39 is formed at a position at a desired height on the internal circumferential wall portion, so as to detect the fact that the piston member 4 has reached a desired set shifting position. Moreover, the set shifting position is not to be considered as being limited to being located at a specified position having no length in the vertical direction; it could also be set to a position having a certain length in the vertical direction; and, in this case, the engagement portion far retraction 39 would be formed on the engagement portion so as to have a certain length in the vertical direction.

Since the closing of the open/shut valve mechanism 11 is detected via the air pressure of the pressurized air that is supplied to the air passage 32, accordingly it is possible to detect the closed state with a simple structure.

Moreover, since the engagement portion for retraction 39 is formed as an annulus around the inner circumferential wall portion of the rod 101 insertion hole 20, accordingly it is possible to ensure the proper functioning of the engagement portion for retraction 39, even if the piston member 4 rotates around its axis.

Furthermore since, in this twist-type clamp device 1, the twisting mechanism 8 is installed to the piston member 4 and the main cylinder body 10 of the hydraulic pressure cylinder 2 and twists the output rod 6 around its own axis by a set angle together with the to and fro movement of the output rod 6, accordingly this structure enables detection of the filet that the piston member 4 of the twisting type clamp device 1 is positioned in its set shifting position via the air pressure of the pressurized air.

Yet further, since the installation hole 21 in the base member 13 to which the twist-type clamp device 1 is attached, into which the lower portion of the clamp main body 10 is inserted from above and in which it is installed, consists of the lower installation hole portion 22 and the upper installation hole portion 23 that has a diameter slightly larger than that of the lower installation hole portion 22, and since the lower end portion of the clamp main body 10 and the seal member 24*a* that is installed on its external peripheral portion are installed in the lower installation hole portion 22 accordingly, even if some burring; remains at the upper end of the air passage 43 that opens into the upper installation hole portion 23, still no damage is caused to the seal member 24*a* due to this burring when the lower end portion of the clamp main body 10 is inserted into and installed in the lower installation hole portion 22.

Embodiment 2

A twist-type clamp device 1A according to a second embodiment of the present invention will now be explained on the basis of FIGS. 7 through 10. However, the same reference symbols will be appended to structural elements having similar structures to elements in the first embodiment, and explanation thereof will be omitted, with only structural elements that are different being explained.

The hydraulic pressure cylinder 2A of this twist-type clamp device 1A is built so that, when the piston member 4A is positioned in the upper half portion of its raising and lowering stroke (including its unclamp position), the open/shut valve mechanism 11 maintains its opened state; and, when the piston member 4A is positioned in the lower half portion of its raising and lowering stroke (including its clamp position), the open/shut valve mechanism 11 maintains its shut state.

Figure 7:
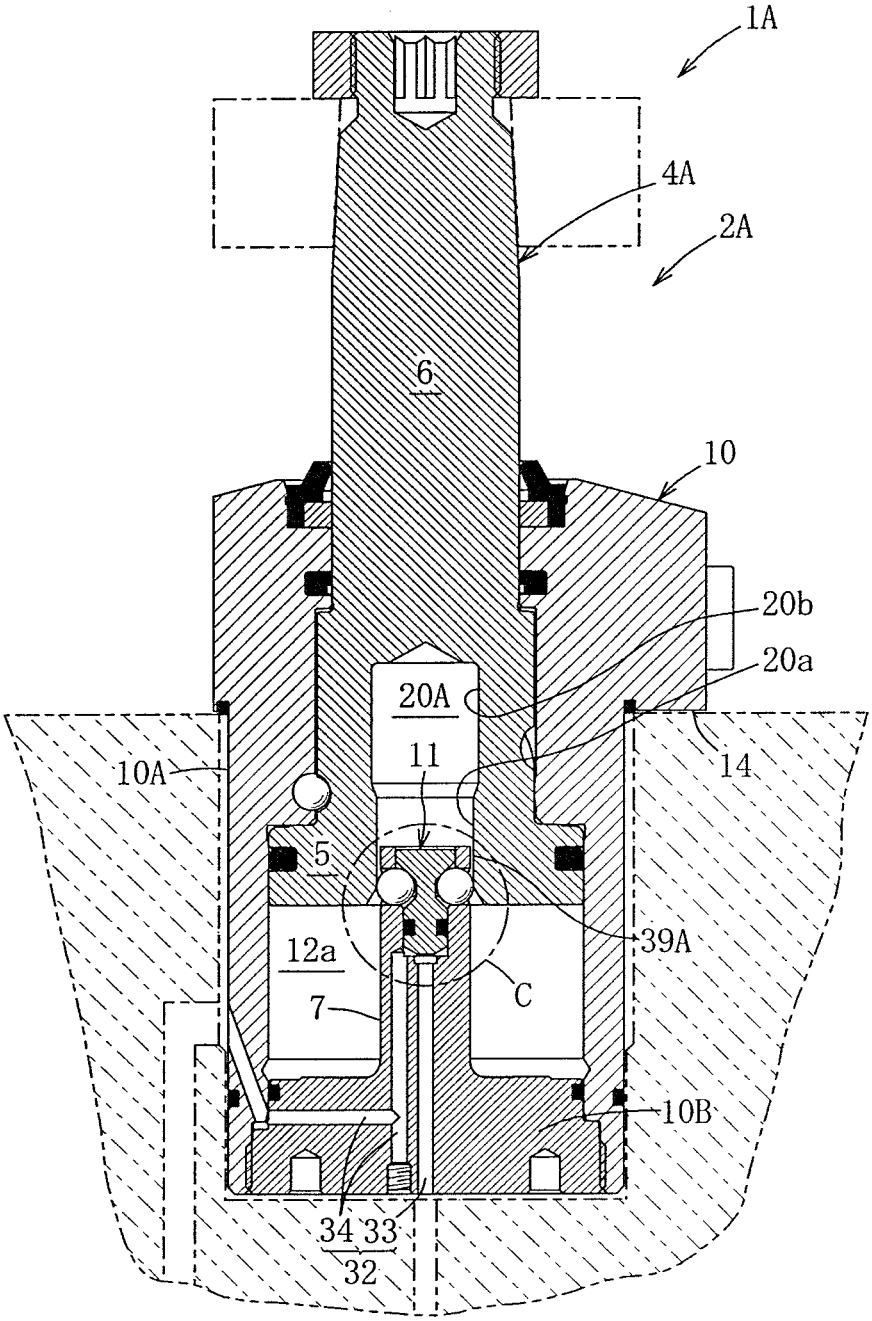
FIG. 7 is a vertical sectional view of a twist-type clamp device (unclamped state) of a second embodiment.
Figure 8:
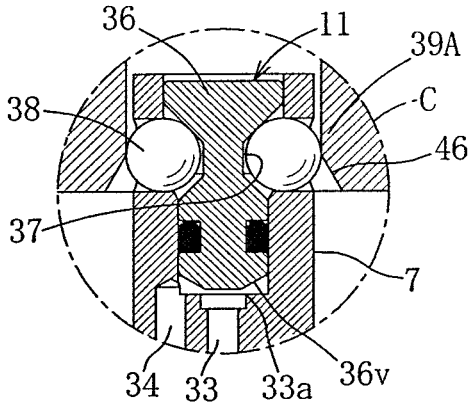
FIG. 8 is an enlarged view of a portion C of FIG. 7.

As shown in FIGS. 7 and 8, the lower half portion of the rod insertion hole 20A is formed as a small diameter rod insertion hole 20*a* having a similar internal diameter to that of the rod insertion hole 20 of the first embodiment, while the upper half portion of the rod insertion hole 20A is formed as a large diameter rod insertion hole 20*b* having an internal diameter that is slightly larger (for example, 3 to 4 mm larger) than the internal diameter of the small diameter rod insertion hole 20*a*.

When the piston member 4A is positioned in the upper half portion of its raising: and lowering stroke (which corresponds to the "set shifting position"), the valve body 36 receives the hydraulic pressure in the rod insertion hole 20A; but, since the spherical bodies 38 are restricted by the internal circumferential wall surface of the small diameter rod insertion hole 20*a* and therefore are pushed toward the valve body 36 (its axial side), accordingly the spherical bodies 38 push the upper side conical surface portion 37*b* of the valve body 36 and shift it slightly upward, so that the open/shut valve mechanism 11 maintains its opened state. In other words, the internal circumferential wall surface of the small diameter rod insertion hole 20*a* (i.e. its inner circumferential wall portion) is equivalent to an engagement portion 39A for pressing and shifting.

Figure 9:
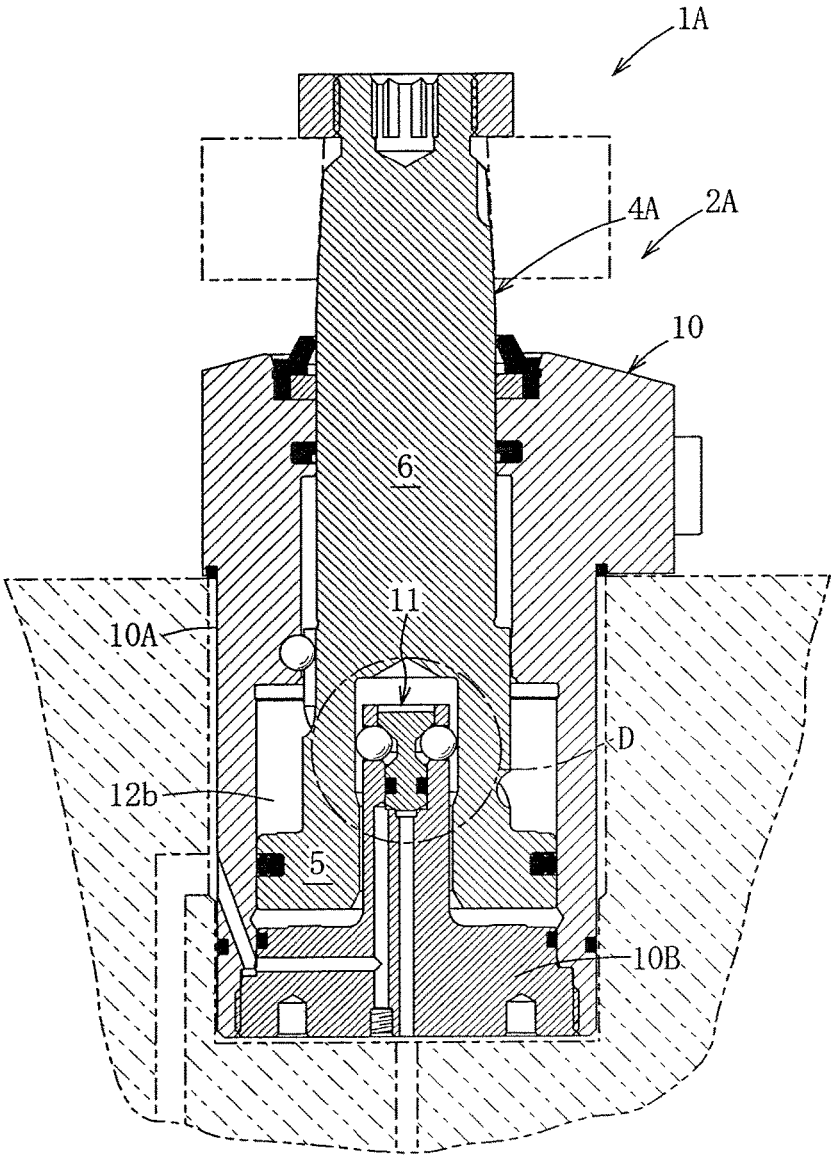
FIG. 9 is a vertical sectional view of the clamp device (clamped state) of FIG. 7.
Figure 10:
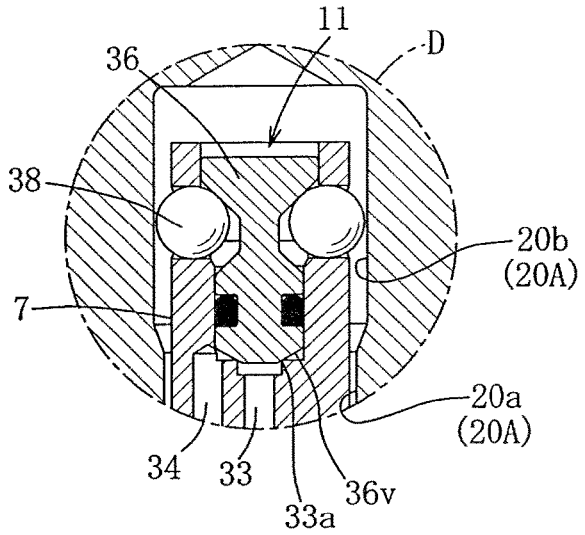
FIG. 10 is an enlarged view of a portion D of FIG. 9.

And, when the piston member 4A is positioned in the lower half portion of its raising and lowering stroke as shown in FIGS. 9 and 10, since the spherical bodies 38 shift outwards until they contact against the inner circumferential wall surface of the large diameter rod insertion hole 20*b*, accordingly the valve body 36 shifts slightly downward due to the remaining pressure within the rod insertion hole 20A that operates on the valve body 36, and the open/shut valve mechanism 11 maintains its closed state.

Embodiment 3

A twist-type clamp device 1B according to a third embodiment of the present invention will now be explained on the basis of FIGS. 11 through 14. However, the same reference symbols will be appended to structural elements having similar structures to elements in the first embodiment, and explanation thereof will be omitted, with only structural elements that are different being explained.

Similarly to the hydraulic pressure cylinder 2A of the second embodiment, the hydraulic pressure cylinder 2B of this twist-type clamp device 1B is built so that, when the piston member 4B is positioned in the upper half portion of its raising and lowering, stroke (including its unclamp position), the open/shut valve mechanism 11 maintains its opened state; and, when the piston member 4B is positioned in the lower half portion of its raising and lowering stroke (including its clamp position), the open/shut valve mechanism 11 maintains its closed state. However, the structure of this hydraulic pressure cylinder 2B is different from that of the hydraulic pressure cylinder 2A of the second embodiment, in that a compression spring 50 is installed to the open/shut valve mechanism 11 that elastically biases the valve body 36 in the valve shutting direction.

Figure 11:
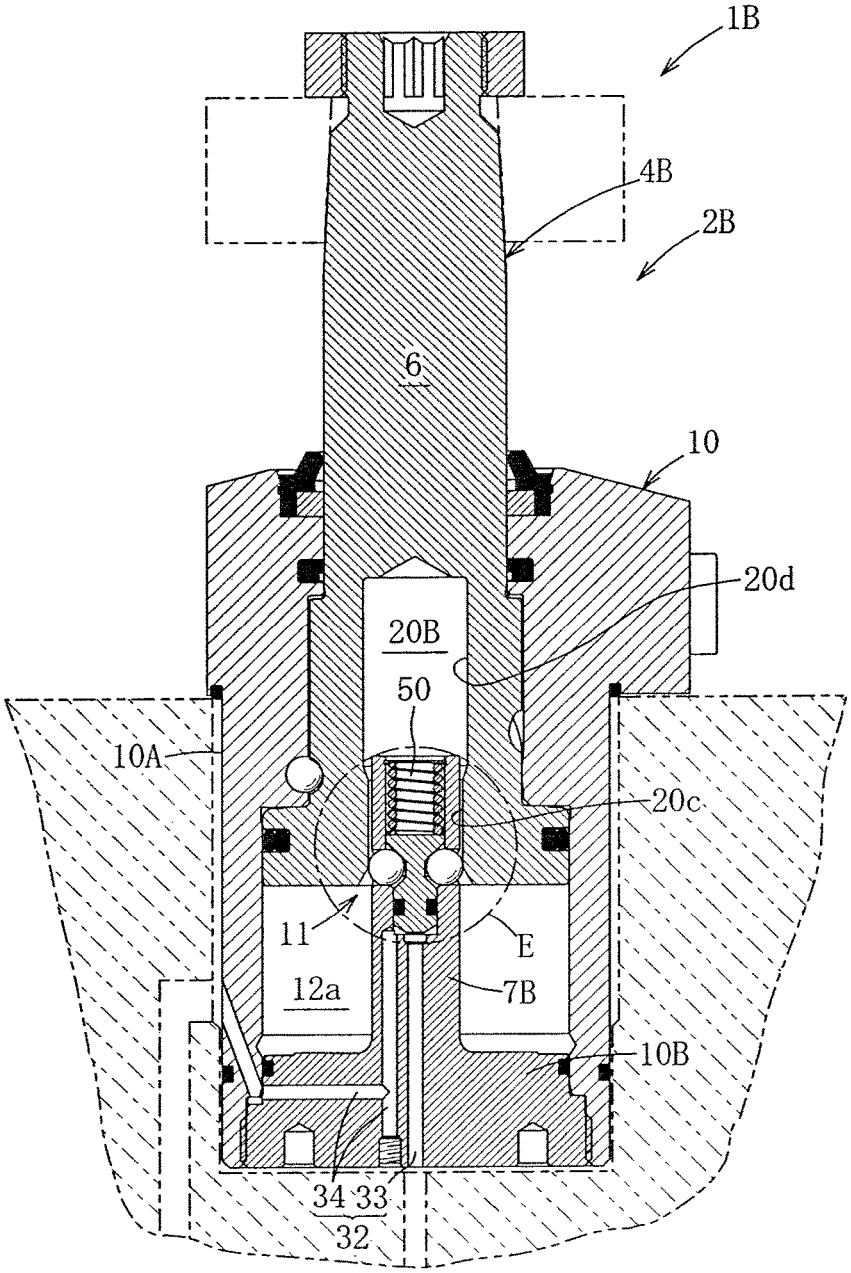
FIG. 11 is a vertical sectional view of a twist-type clamp device (unclamped state) of a third embodiment.
Figure 12:
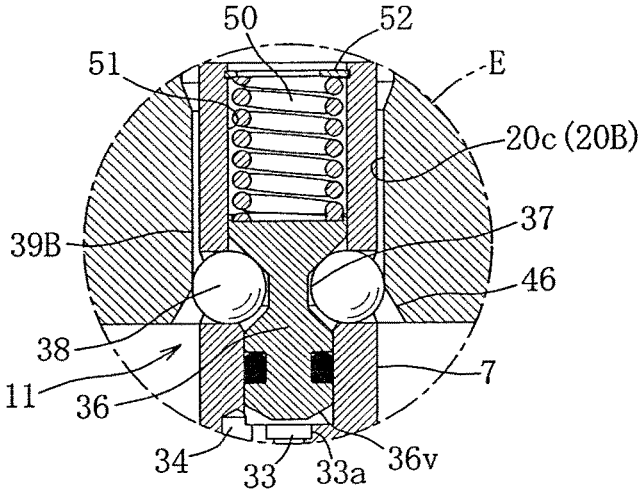
FIG. 12 is an enlarged view of a portion E of FIG. 11.

As shown in FIGS. 11 and 12, the auxiliary rod 7B is extended upward, a cylindrical containment aperture 51 is formed in the upper end portion of the auxiliary rod 7B and contains the spring 50, the compression spring 50 that elastically biases the valve body 36 towards the valve shutting side is installed in the containment aperture 51, and the upper end of the compression spring 50 bears against a stop ring 52. In correspondence to the upward elongation of the auxiliary rod 7B, the rod insertion hole 20B is also extended upward.

As shown in FIGS. 11 and 12, the lower portion of the rod insertion hole 20B (approximately ⅖ thereof) is formed as a small diameter rod insertion hole 20*c* having an internal diameter similar to that of the rod insertion hole 20 of the first embodiment, with the internal circumferential wall surface of the small diameter rod insertion hole 20*c* (i.e. its internal circumferential wall portion) being equivalent to an engagement portion 39B for pressing and shifting, in the same manner as the engagement portion 39A for pressing and shifting of the second embodiment. And the upper half portion of the rod insertion hole 20B (approximately ⅗ thereof) is formed as a large diameter rod insertion hole 20*d* having an internal diameter that is slightly larger (for example, 3 to 4 mm larger) than the internal diameter of the small diameter rod insertion hole 20*c*.

When the piston member 4B is positioned in the upper half portion of its raising and lowering stroke (which corresponds to the set shifting position), the valve body 36 receives the hydraulic pressure in the rod insertion hole 20A; but, since the spherical bodies 38 are restricted by the internal circumferential wall surface of the small diameter rod insertion hole 20*c* and therefore are pushed toward the valve body 36 (its axial side), accordingly the spherical bodies 38 push the upper side conical surface portion 37*b* of the valve body 36 and shift it slightly upward against the resistance of the compression spring 50, so that the open/ shut valve mechanism 11 maintains its opened state. In other words, the internal circumferential wall surface of the small diameter rod insertion hole 20*c* (i.e. its inner circumferential wall portion) is equivalent to an engagement portion 39B for pressing and shifting.

Figure 13:
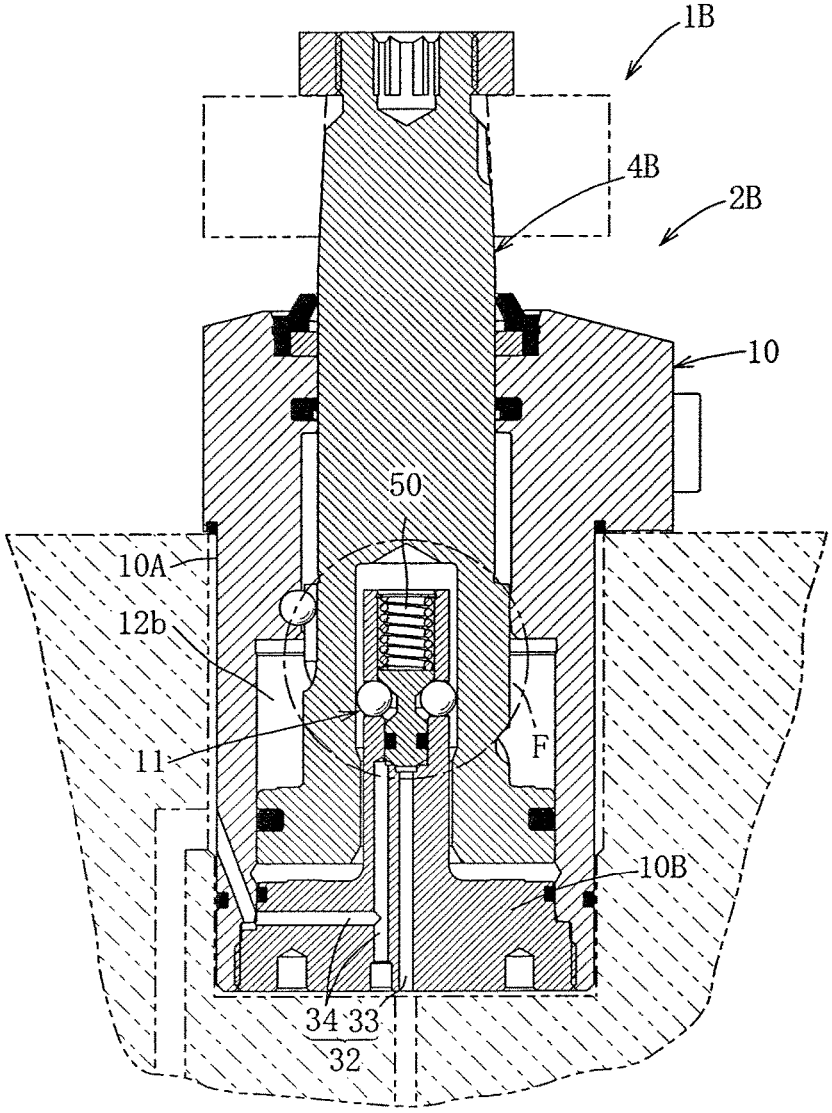
FIG. 13 is a vertical sectional view of the clamp device (clamped state) of FIG. 11.
Figure 14:
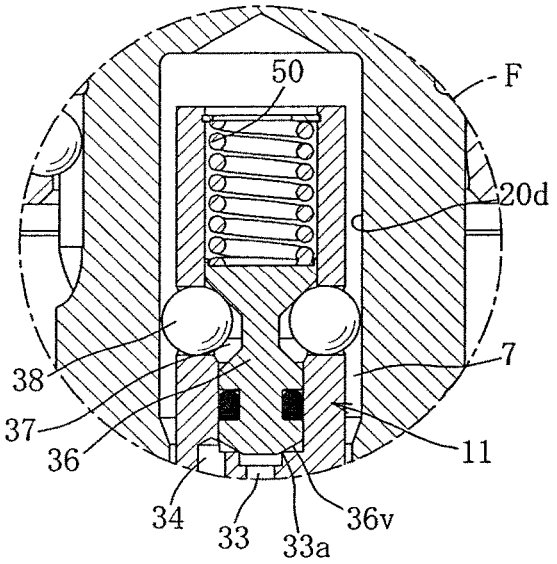
FIG. 14 is an enlarged view of a portion F of FIG. 13.

And, when the piston member 4B is positioned in the lower half portion of its raising and lowering stroke as shown in FIGS. 13 and 14, since the spherical bodies 38 shift outwards until they contact against the inner circumferential wall surface of the large diameter rod insertion hole 20*d*, accordingly the valve body 36 shifts slightly downward due to the biasing force of the compression spring 50, and the open/shut valve mechanism 11 maintains its closed state, in this hydraulic pressure cylinder 2B, since the compression spring 50 is installed that biases the valve body 36 in the shutting direction, accordingly the valve closing performance and the operational reliability are enhanced.

Variant examples in which the twist-type clamp devices of the above embodiments are partially altered will now be explained.

(1) If a similar engagement portion to the engagement portion for retraction 39 is formed on the inner circumferential wall portion of the rod insertion hole 20 at a portion corresponding to the position of the spherical bodies 38 in FIG. 5, then it also becomes possible to detect the fact that the piston member 4 has shifted to the clamp position in addition to the fact that the piston member 4 is in the unclamp position.

(2) Instead of the annular recessed engagement portion 37, it would also be acceptable to arrange to form a recessed engagement portion, into which the spherical bodies 38 are capable of engaging, on a portion of the valve body 36 in its circumferential direction that is not annular.

(3) The direction of flow of the pressurized air that flows in the air passage 32 is not limited to being the direction shown in the above embodiments; it would also be acceptable to provide a structure in which the pressurized air supply source 40 is connected to the air passage 34, and the air flows from the air passage 34 toward the air passage 33.

(4) Since the engagement portion for retraction 39 that is formed on the piston member 4 is a configuration for allowing the spherical bodies 38 to retract outward, accordingly it is not necessary for the portion for retraction to be in linear contact or in planar contact with the spherical bodies 38; any construction will be acceptable that can allow the spherical bodies to retract outward, and that can make them return to the state shown in FIGS. 5 and 6.

(5) It would be acceptable to form the engagement portion 39A for pressing and shifting shown in FIG. 7 only at a site that corresponds to the unclamp position; or, alternatively, it would also be possible to form such portions at two sites, one of which corresponds to the unclamp position and one of which corresponds to the clamp position.

(6) The hydraulic pressure cylinders 2, 2A, and 2B of the present invention could also be applied to clamp devices of various types, other than the twist-type clamp devices 1, 1A, and 1B.

DESCRIPTION OF NUMERALS

1, 1A, 1B: twist-type clamp device
2, 2A, 2B: hydraulic pressure cylinders (fluid pressure cylinders)
3: clamp arm
4, 4A, 4B: piston members
5: piston portion
6: output rod
7: auxiliary rod
8: twisting mechanism
10: main cylinder body
10B: head side end wall member
11: open/shut valve mechanism for detection
12*a*: hydraulic pressure operation chamber for unclamping
12*b*: hydraulic pressure operation chamber for clamping
13: base member
15: cylinder bore
20: rod insertion hole
32: air passage (fluid passage)
35: valve body reception hole
36: valve body
37: recessed engagement portion
38: spherical body
39: engagement portion for retraction
39A, 39B: engagement portions for pressing and shifting
50: compression spring

The invention claimed is:

1. A fluid pressure cylinder comprising a main cylinder body having a cylinder bore is formed, a piston member having a piston portion that is movably received in the cylinder bore and an output rod extending from the piston portion to an exterior of the main cylinder body, and a fluid pressure operation chamber that is defined in the cylinder bore, and characterized by comprising:

a rod insertion hole that is formed at a central portion of a base end portion of the piston member and that opens to the base end, and into which a fluid pressure in the fluid pressure operation chamber is introduced;

an auxiliary rod that is provided on a head side end wall member of the main cylinder body so as to project within the cylinder bore, and that can be inserted into the rod insertion hole;

an open/shut valve mechanism for detection that is installed to the auxiliary rod; and a fluid passage that is formed in the main cylinder body and the auxiliary rod, and that is opened and shut by the open/shut valve mechanism;

wherein the open/shut valve mechanism comprises:

a valve body reception hole that is formed in an top end side portion of the auxiliary rod to be parallel to an axis of the cylinder bore, and that communicates with the rod insertion hole;

a valve body that is movably received in the valve body reception hole and that has a recessed engagement portion on an external peripheral portion; and a spherical body that is movably fitted to the auxiliary rod so as to engage with the recessed engagement portion;

and, when the piston member reaches a set shifting position that is set in advance, the valve body is changed over to a shut position or to an open position due to cooperation between the spherical body, the recessed engagement portion, and a rod insertion hole inner circumferential wall portion.

2. The fluid pressure cylinder according to claim 1, wherein an engagement portion for retraction is formed on the inner circumferential wall portion of the rod insertion hole and, when the piston member is in the set shifting position, puts the valve body into the shut position by permitting the spherical body to retract in a direction to recede away from the axis.

3. The fluid pressure cylinder according to claim 2, wherein, when the piston member is shifted from the set shifting position, the valve body is changed over to the open position due to cooperation between the spherical body, the recessed engagement portion, and the rod insertion hole inner circumferential wall portion.

4. The fluid pressure cylinder according to claim 1, wherein an engagement portion for pressing is formed on the inner circumferential wall portion of the rod insertion hole, and, when the piston member is in the set shifting position, puts the valve body into the open position by causing the spherical body to shift in a direction to approach toward the axis.

5. The fluid pressure cylinder according to claim 1, wherein the valve body is biased toward the shut position by fluid pressure in the rod insertion hole which is communicated with the fluid pressure operation chamber.

6. The fluid pressure cylinder according to claim 1, wherein a compression spring is provided that elastically biases the valve body toward the head side end wall member.

7. The fluid pressure cylinder according to claim 1, wherein a shut state of the open/shut valve mechanism can be detected via a fluid pressure that is supplied to the fluid passage.

* * * * *